US005865852A

United States Patent [19]

Berndt

[11] Patent Number: 5,865,852

[45] Date of Patent: Feb. 2, 1999

[54] DRY CLEANING METHOD AND SOLVENT

[76] Inventor: Dieter R. Berndt, P.O. Box 4413, Incline Village, Nev. 89450

[21] Appl. No.: 918,629

[22] Filed: Aug. 22, 1997

[51] Int. Cl.[6] ..... D06L 1/02; D06L 1/08

[52] U.S. Cl. ..... 8/142; 8/135; 510/285; 510/291; 510/407; 510/413

[58] Field of Search ..... 8/142, 137; 510/285, 510/291, 407, 413

[56] References Cited

U.S. PATENT DOCUMENTS 5,104,564 4/1992 Lermond et al. ..... 510/412

5,439,947 8/1995 Bartlett et al. ..... 521/131

5,597,792 1/1997 Klier et al. ..... 510/417

*Primary Examiner*—Alan Diamond

*Attorney, Agent, or Firm*—Leonard Tachner

[57] ABSTRACT

A method of dry cleaning articles such as clothing and the like including the use of Dipropylene Glycol Monomethyl Etheracetate as the cleaning solvent and the use of vacuum to assist in the removal of solvent from the articles and the use of vacuum distillation of the solvent after a cleaning cycle.

3 Claims, 1 Drawing Sheet

DRY CLEANING METHOD AND SOLVENT

BACKGROUND OF THE INVENTION

I. Field of the Invention

This invention is in the general field of dry cleaning of clothing, other fabrics, and the like;

The invention is more particularly directed to a method for dry cleaning utilizing specially designed machinery and uniquely modified solvents and treatment cycles;

The invention is more particularly directed to a dry cleaning method wherein a solution is utilized which has the desirable and safe flash point rating and the fabric-safe qualities required, together with superior, specially designed dry cleaning machinery;

The invention, therefore, is most particularly directed to a totally new dry cleaning method.

II. Description of the Prior Art

The prior art in dry cleaning includes the use of various solvents with appropriate machinery to accomplish the cleaning. In the most recent past the solvent most widely used has been perchloroethylene ( hereafter generally referred to as "perc") Perc has the disadvantage that it is environmentally very destructive and undesirable. In some areas perc is no longer allowed to be used. Additionally, in the past other solvents such as petroleum based solvents and glycol esters, ethers, and acetates have been tried and used. These various solvents have been used with machinery which may not have been ideal.

The present invention is distinct from the prior art in that it relies upon a specially formulated solvent with unusual characteristics as described below, together with a specific method involving the use of specialized machinery designed specifically into a complete dry cleaning method.

SUMMARY OF THE INVENTION

Dry Cleaning is a major industry throughout the world. In the United States of America, alone, there are more than fifty thousand dry cleaners (many of these have multiple locations).

The dry cleaning industry is an essential industry in the present economy. Many articles of clothing (and other items) must be dry cleaned in order to remain clean, presentable, and useable in today's business and cultural climate. It is difficult to imagine an executive attending a meeting, a job applicant for a position of any importance, an entertainer, a suitor, or any person anticipating a social or business encounter, who does not appear in freshly dry cleaned garments.

The most widely used dry cleaning solvent until now has been perc. There are many disadvantages to perc including its toxicity and odor. The machinery most widely used, until now, has been manufactured specifically for use with perc. This has been another limiting factor in this industry.

Another problem in this field is that different fabrics require different handling in the presently used systems in order to prevent damage to the fabrics during the dry cleaning process.

I have now developed a complete dry cleaning system, or method, in which specially designed machinery, solvents, and sequences of operations combine to result in a totally environmentally friendly process which is, also, more effective in cleaning fabrics and the like than any prior know system.

It is an object of this invention to provide a method of dry cleaning using environmentally friendly solutions and techniques;

It is another object of this invention to provide a dry cleaning method wherein the articles being cleaned are not harmed;

Another object of this invention is to provide a method for economical dry cleaning of all types of fabrics.

The foregoing and other objects and advantages of this invention will become apparent to those skilled in the art after reading the description of a preferred embodiment, which follows, in conjunction with a review of the appended drawings.

DESCRIPTION OF A PREFERRED EMBODIMENT

Figure 1:
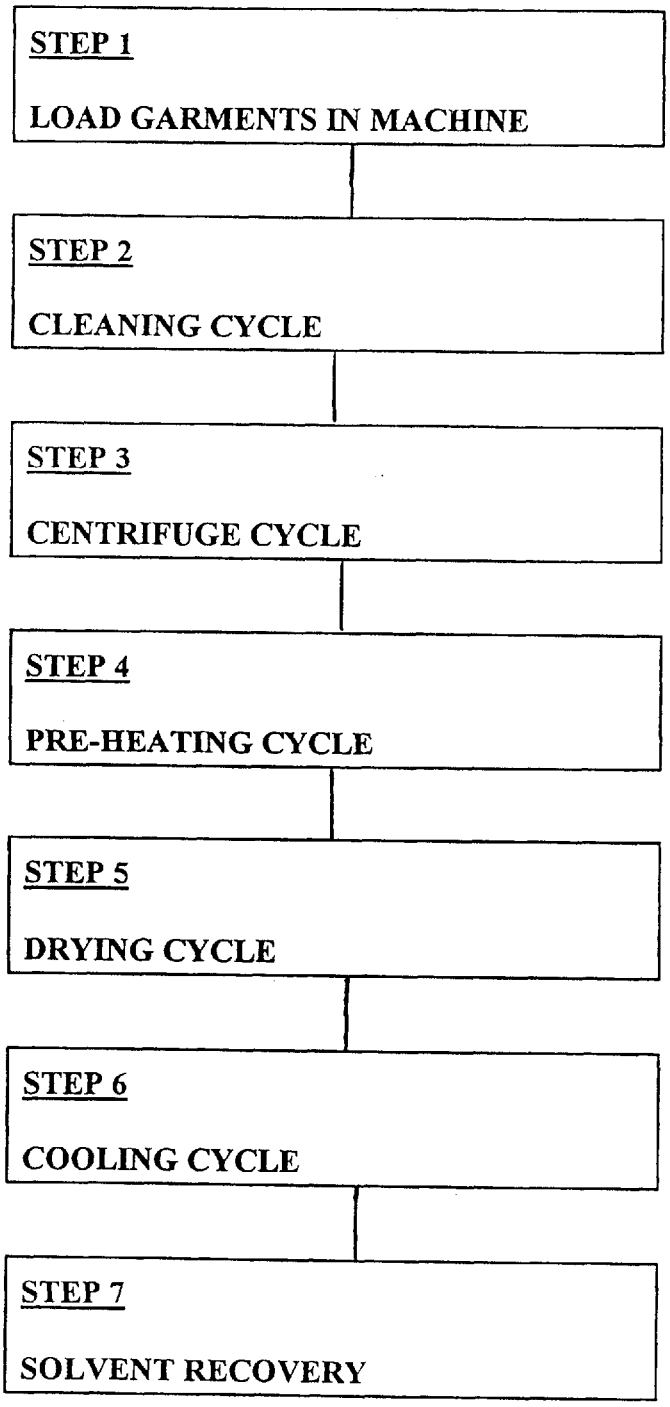
FIG. 1 is a block diagram of the steps involved in practicing the method of this invention.

This method of dry cleaning is unique, particularly in the use of a commonly known solvent, Dipropylene Glycol Monomethyl Etheracetate ( DPMA ). This solvent has never been considered as a dry cleaning solvent, and, in fact, it is not suitable for dry cleaning in pure form. It is used in my new dry cleaning method as modified.

Referring to the block diagram, FIG. 1, the steps of the entire system and the mechanisms and solvent used will be understood by those skilled in the art.

At step 1 garments or other items to be dry cleaned are placed in a vertical combination washer dryer with a horizontally rotating agitating cleaning basket ( known to those skilled in the art ). The barrel of the basket will have numerous holes, preferably each hole will be ¼ to ⅜ inch diameter.

At step 2 the wash cycle is initiated with DPMA and water being used by the machine as the solvent. The DPMA is mixed with a small quantity of water, preferably not exceed five percent. The mixing of water into the DPMA is highly unusual and is the key to the use of DPMA as a dry cleaning solvent. Without the small amount of water the DPMA will not perform proper cleaning of fabrics. The solvent is pumped by an in line pump into the cleaning basket. The items being cleaned are agitated preferably for from six to eight minutes. The solvent is then pumped back into the holding tank through a charcoal and clay filter system in order to remove impurities which may have been left from the cleaning.

At step 3 the items being cleaned are spin dried, preferably for about three to five minutes preferably at somewhere from 450 to 750 revolutions per minute. This operation leaves no more than five percent solvent residue in the items being cleaned.

At step 4 the garments are preheated, preferably for two or three minutes. This is best accomplished by passing pressurized steam through a coil in the machine which heats the air inside the basket with the use of a circulating fan. When the inside basket temperature reaches about 130 to 140 degrees Fahrenheit the machine is put under a negative pressure of at least 500 millimeters of mercury. This is accomplished by drawing a vacuum directly from the machine enclosure, which houses the cleaning basket, in this system should be designed to hold a vacuum of about 200 millimeters of mercury. Those skilled in the art will understand how this is accomplished.

At step 5, with the help of the vacuum, the solvent remaining in the garments is caused to reach the flash point ( flash points are understood by those skilled in the art ) of 203 degrees Fahrenheit without increasing the drying temperature. The drying temperature is at a maximum of about 150 degrees Fahrenheit. This is an important feature of this method with the solvent of this method. If garments should be dried at a temperature of 200 degrees Fahrenheit the garments would be destroyed. On the other hand, if the solvents flash point has not been reached, solvent would remain in the garments. Thus, the value of the unique vacuum drying used in this method is recognized. It is further to be noted that this is an essential and important advance in the industry, since this will apply to, and make possible the use of, any and all solvents which have high flashpoints ( probably about 170 degrees Fahrenheit and higher ). Now the flash point has been reached and the solvent remaining in the cleaned items vaporizes and leaves the items. This cycle will be around 15 to 25 minutes At step 6 we have the cooling cycle. At this point the temperature is about 120 degrees Fahrenheit and the vacuum is at about 300 millimeters of mercury. The solvent vapor is circulated through refrigerated coils ( preferably around 38 degrees Fahrenheit ). The vaporized solvent then reverts to a liquid. The liquid passes into a solvent/water separator. Typically this cycle will be around 3 to 6 minutes.

Lastly, at step 7, a vacuum distillation unit ( known to those skilled in the art ), which is a part of the overall machine, is used to distill the solvent at about 100 to 120 degrees Centigrade to give the solvent an extended useful life ( if the solvent was distilled at 200 degrees Fahrenheit it would be destroyed ). It is necessary to distill used solvent to remove impurities such as fatty acids, dyes, dirt and the like accumulated during the cleaning process.

I claim:

1. The method of dry cleaning articles comprising: immersing articles to be dry cleaned in a dry cleaning solvent having Dipropylene Glycol Monomethyl Etheracetate (DPMA); agitating the articles in the DPMA; and removing the DPMA from the articles wherein the articles being dry cleaned, after having been cleaned, are subjected to a vacuum by reducing pressure in order to reduce the flash point of the dry cleaning solvent; and vaporizing any dry cleaning solvent remaining in the article.

2. The method recited in claim 1 wherein said dry cleaning solvent comprises not less than 95% Dipropylene Glycol Monomethyl Etheracetate by weight and not more than 5% water by weight.

3. The method of dry cleaning articles comprising: placing articles to be dry cleaned in the cleaning basket of a washer/dryer; introducing Dipropylene Glycol Monomethyl Etheracetate (DPMA) into the cleaning basket; agitating the articles in the DPMA in the cleaning basket; centrifuging the articles within the cleaning basket to remove DPMA; subjecting the articles within the cleaning basket to a partial vacuum; heating the articles within the cleaning basket and under the partial vacuum; and removing the articles from the cleaning basket.

* * * * *